US006643961B1

(12) United States Patent
Hluchan

(10) Patent No.: US 6,643,961 B1
(45) Date of Patent: Nov. 11, 2003

(54) MULTI-PANEL DISPLAY SYSTEM

(75) Inventor: Erik S. Hluchan, Deep River, CT (US)

(73) Assignee: Structural Graphics LLC, Essex, CT (US)

( * ) Notice: Subject to any disclaimer, the term of this patent is extended or adjusted under 35 U.S.C. 154(b) by 0 days.

(21) Appl. No.: 10/265,544

(22) Filed: Oct. 4, 2002

Related U.S. Application Data

(60) Provisional application No. 60/327,283, filed on Oct. 5, 2001.

(51) Int. Cl.[7] ..... G09F 7/00

(52) U.S. Cl. ..... 40/492; 40/534; 446/152

(58) Field of Search ..... 40/492, 534, 376, 40/124.2, 733, 604; 283/98, 99, 106, 56; 446/69, 147, 152

(56) References Cited

U.S. PATENT DOCUMENTS

| | | | | | |
|---|---|---|---|---|---|
| 901,357 | A | * | 10/1908 | Lewis | 229/72 |
| 903,514 | A | | 11/1908 | Snyder | |
| 964,228 | A | | 7/1910 | Fowler | |
| 1,050,831 | A | | 1/1913 | Hoffman | |
| 1,063,577 | A | | 6/1913 | Moran | |
| 1,381,925 | A | | 6/1921 | Lund | |
| 1,450,816 | A | | 4/1923 | Ordung | |
| 1,554,322 | A | | 9/1925 | Banta | |
| 1,608,713 | A | * | 11/1926 | Anderson | 33/458 |
| 1,713,153 | A | | 5/1929 | Webber | |
| 2,334,487 | A | | 11/1943 | Greenway | |
| 2,736,959 | A | | 3/1956 | Simon et al. | |
| 3,318,311 | A | * | 5/1967 | Gressette et al. | 40/376 |
| 4,070,775 | A | * | 1/1978 | Brooks | 40/492 |
| 4,104,809 | A | * | 8/1978 | Day et al. | 40/492 |
| 4,197,665 | A | | 4/1980 | Siiter | |
| 4,920,675 | A | | 5/1990 | Mashimo | |
| 4,984,825 | A | | 1/1991 | Fowler | |
| 5,002,181 | A | * | 3/1991 | Leppo | 283/98 |
| 5,038,926 | A | | 8/1991 | van der Toorn | |
| 5,358,280 | A | | 10/1994 | Scales | |
| 5,871,237 | A | | 2/1999 | Hunt | |
| 6,099,043 | A | | 8/2000 | Story | |

* cited by examiner

*Primary Examiner*—Gary Hoge
(74) *Attorney, Agent, or Firm*—Melvin I. Stoltz

(57) ABSTRACT

By providing a unique, pre-printed housing member within which a plurality of pre-printed display members are operatively interconnected for sequential display relative to each other in a unique, co-operative, continuously unfolding construction, a unique, hands-on, printed, visually exciting and interest-generating multi-panel product is attained. In the present invention, a principal housing or first element is provided which incorporates a front panel and a rear panel mounted in juxtaposed, spaced relationship with each other, defining a first interior zone therebetween. Preferably, each panel comprises an eye-catching, visual display for generating consumer interest. In addition, a second element is mounted between the front panel and a rear panel of the first element in a manner which enables the second element to pivot outwardly from the first element from a first fully stowed position to a second fully displayed position. Furthermore additional elements are also employed with each element being pivotally mounted in the adjacent element in substantially the same manner, achieving a display system wherein virtually any desired number of elements can be employed for providing numerous products, such as promotional/advertising products and/or interest-generating greeting cards.

20 Claims, 4 Drawing Sheets

Fig. 6

MULTI-PANEL DISPLAY SYSTEM

RELATED APPLICATIONS

This application is related to U.S. Provisional Patent Application Ser. No. 60/327,283, filed Oct. 5, 2001 entitled ADVERTISING/PROMOTIONAL DISPLAY SYSTEM.

TECHNICAL FIELD

This invention relates to multi-panel products and, more particularly, to such products which enable arcuate movements of adjacent components thereof.

BACKGROUND ART

With the ever increasing quantity of products and services being offered to consumers, substantial interest has been given to promotional systems for advertising such products and services. In this regard, a wide variety of advertising displays and promotional literature has been created and distributed to consumers. However, due to the deluge of material to which average consumers are constantly exposed, greater emphasis has been placed upon developing eye-catching, visual displays and promotional material which will receive consumer attention.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when activated or unfolded. However, in spite of the unique visual appearance generated by such products, the overall cost of production and complexity of assembly of these systems has prevented such prior art systems from becoming popular.

Other prior art displays have attempted to generate consumer interest by providing unique visual images or other indicia as an integral part of the display. However, these prior art attempts have also failed to generate the consumer interest being sought, largely due to an inability to physically involve the consumer in the promotion or display.

In addition, other products, such as greeting cards have attempted to generate consumer interest. However, consumer involvement in the card display has not been achieved.

Therefore, it is a principal object of the present invention to provide a printed, multi-panel display product which is capable of being produced at a reasonable cost and provides an exciting, interest-generating display.

Another object of the present invention is to provide a printed multi-panel display product having the characteristic features described above, which enables the consumer to physically control the presentation of the display in a unique hands-on manner.

Another object of the present invention is to provide a printed multi-panel display product having the characteristic features described above which is capable of mass production and assembly.

A further object of the present invention is to provide a multi-panel display product having the characteristic features described above which provides a unique, eye-catching, exciting and surprising display which is produced in response to action by the consumer.

Other and more specific objects will in part be obvious and will in part appear hereinafter.

SUMMARY OF THE INVENTION

By employing the present invention, all of the difficulties and inabilities of the prior art are eliminated and a unique, hands-on, printed, visually exciting and interest-generating multi-panel display product is attained. This desirable result is realized in the present invention by providing a unique, pre-printed housing member within which a plurality of pre-printed display members are operatively interconnected for sequential display relative to each other in a unique, co-operative, continuously unfolding construction.

In accordance with the present invention, a principal housing or first element is provided which incorporates a front panel and a rear panel mounted in juxtaposed, spaced relationship with each other, defining a first interior zone therebetween. Preferably, each panel comprises an eye-catching, visual display for generating consumer interest.

In the preferred construction, a second element is, mounted between the front panel and a rear panel of the first element in a manner which enables the second element to pivot outwardly from the first element from a first fully stowed position to a second fully displayed position. In the preferred embodiment, the second fully displayed position is directly adjacent the first element. In addition, the second element also incorporates a front panel and a rear panel mounted in juxtaposed spaced relationship with each other, defining a second interior zone therebetween.

By employing this invention, the second element is fully retained and stored within the first element, totally hidden from view. However, whenever the consumer or user wishes to display the second element and enjoy the visual impact provided thereby, the second element is pivoted out of its stowed position to its fully displayed position directly adjacent the first element, thereby enabling both the first element and the second element to be in full view.

In the preferred embodiment, further additional elements are also employed, with each element being pivotally mounted in the adjacent element in the same manner as detailed above. In this way, a display system is achieved wherein virtually any desired number of elements can be employed, with each element being sequentially movable from a stored position to a displayed position, in a continuous, "jack-knife" like display construction.

By employing this sequentially movable, multi-element, multi-panel display system, visually exciting and interest generating products are realized, such as greeting cards and advertising/promotional products which enable a consumer to physically engage a portion of the display member and cause each element mounted within the adjacent member to be displayed whenever desired. By continuously moving each display element relative to its adjacent element, a continuous, elongated display system is produced to the enjoyment of the consumer.

Furthermore, by providing pertinent, interest-generating printed indicia on the exposed surfaces of each element, any desired message can be conveyed to the consumer and a unique greeting card and/or promotional display system is achieved which captures the interest, excitement and imagination of the consumer. In this way, consumer interest is generated both in the greeting card and/or the advertising/display product, as well as the message being promoted by the product.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

Figure 7:
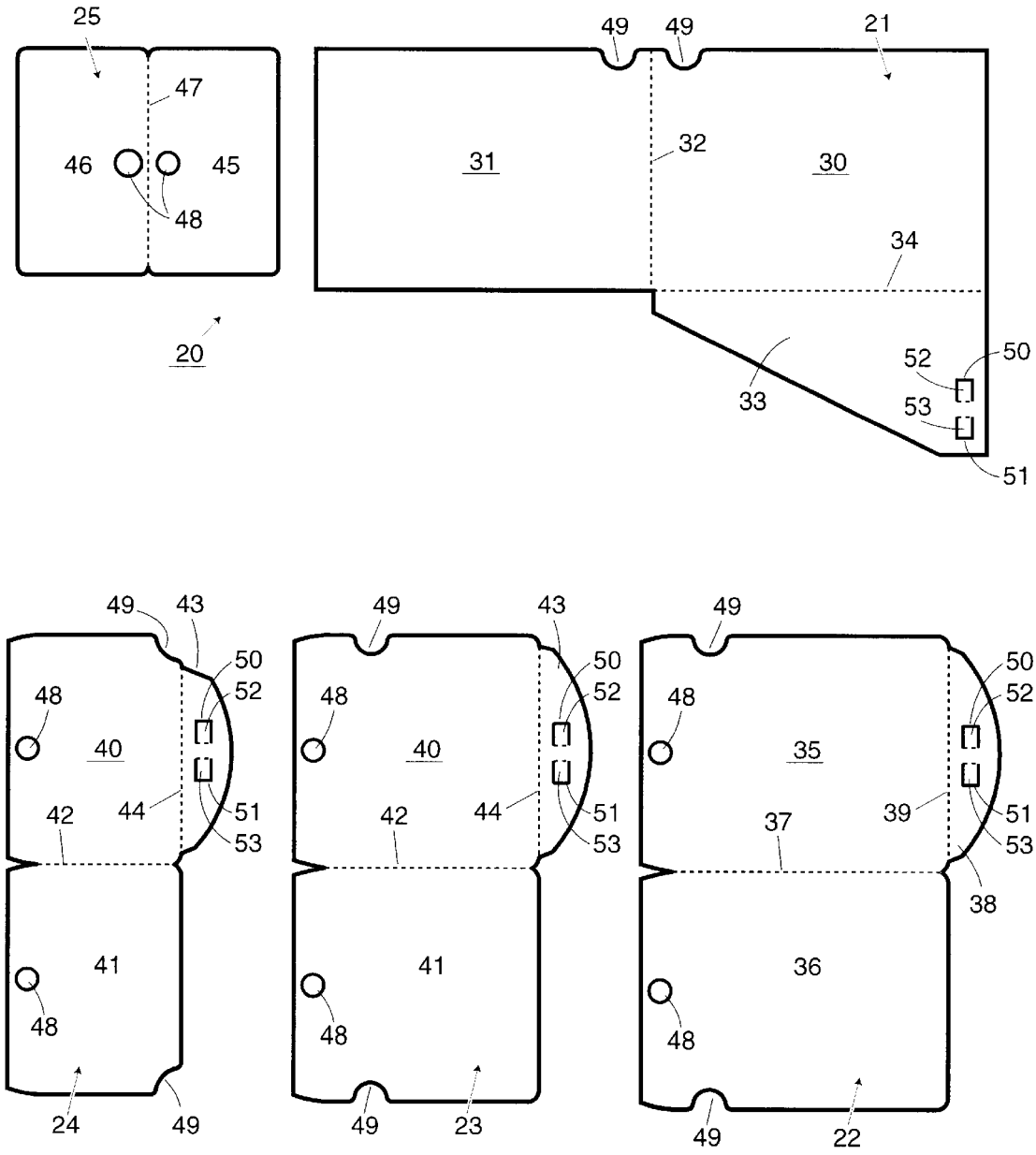
FIG. 7 is a top plan view depicting the multi-panel display system of FIG. 1 in a completely disassembled configuration.
Figure 8:
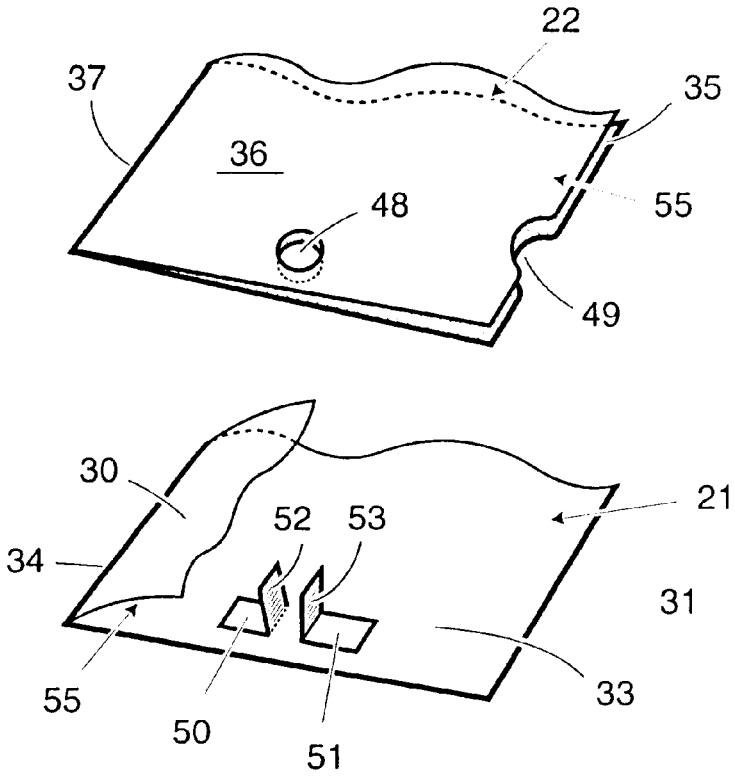
Figure 9:
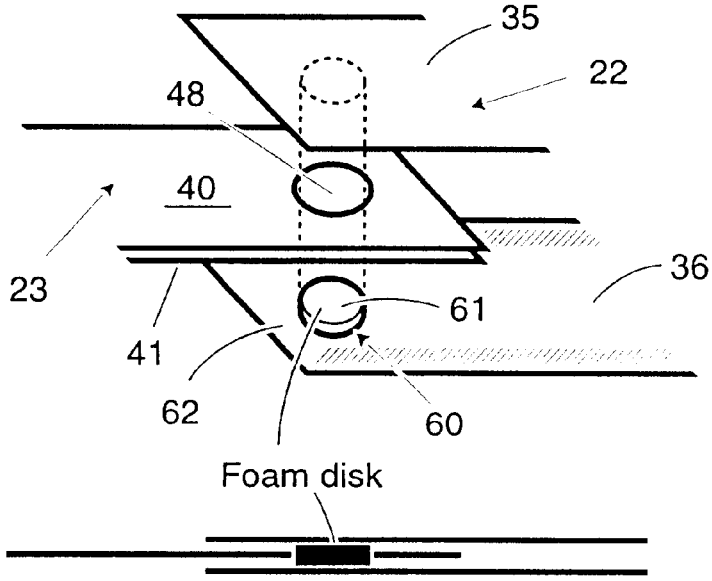

FIG. 8 is an exploded perspective view, partially broken away, depicting two elements of the multi-panel display system of FIG. 7 in the process of being assembled in accordance with one embodiment of the present invention; and FIG. 9 is an exploded perspective view, partially broken away, depicting two elements of the multi-panel display system in the process of being assembled in accordance with an alternate embodiment of the present invention.

DETAILED DISCLOSURE

By referring to FIGS. 1–9, along with the following detailed disclosure, the preferred constructions and operation of the multi-component display product of the present invention can best be understood. Although this disclosure describes two alternate preferred embodiments of the present invention, further alternate embodiments can be made without departing from the scope of this invention. Consequently, it is to be understood that the following disclosure is provided for exemplary purposes only and all alternate embodiments are intended to be encompassed within the scope of the present invention.

As best seen in FIGS. 1–6, multi-component, display product 20 of the present invention comprises a plurality of separate and independent elements or members, each of which are pivotally mounted to the adjacent element/member for being arcuately movable relative thereto from a first stored position to a second fully displayed position. By incorporating any desired number of arcuately pivotable, independent elements or members, an elongated, continuous, sequentially displayed product is attained for delivering any desired message.

In this regard, the present invention may be employed for a plurality of alternate consumer products. In particular, advertising and/or promotional products can be created using this invention. In addition, other products, such as greeting cards, can be constructed using the teaching of this invention. Consequently, these products as well as all other similar products are intended to be within the scope of the present invention.

Figure 1:
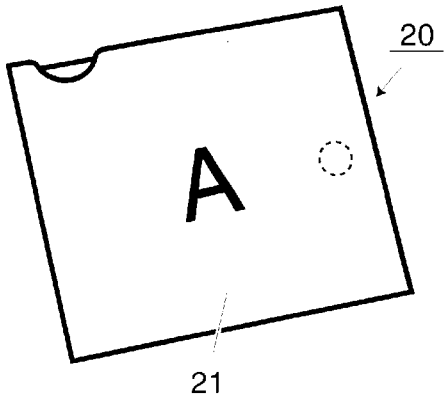
FIG. 1 is a perspective view of a multi-panel display system of the present invention, which incorporates a plurality of independent elements, shown in their initial, fully closed position, displaying the first element thereof.

In FIG. 1, multi-panel display product 20 is depicted in its initial position visually displaying the principal housing or first element/member 21. As detailed below, each of the additional cooperating elements/members are stored within element member 21.

Figure 2:
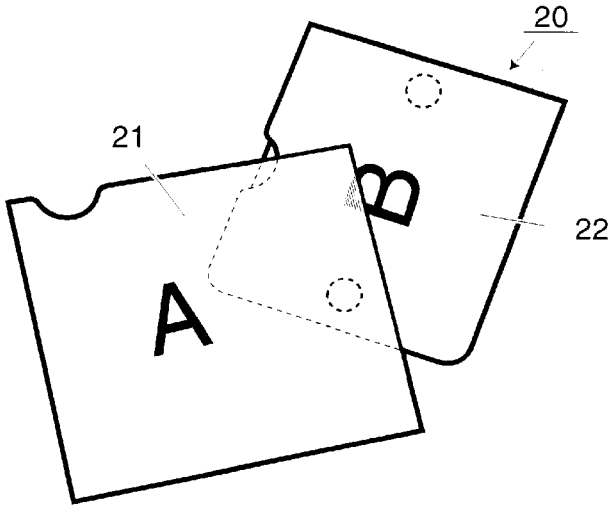
FIG. 2 is a perspective view of the multi-panel display system of FIG. 1 shown with a second element being arcuately pivoted out of its stored position from within the first element.
Figure 3:
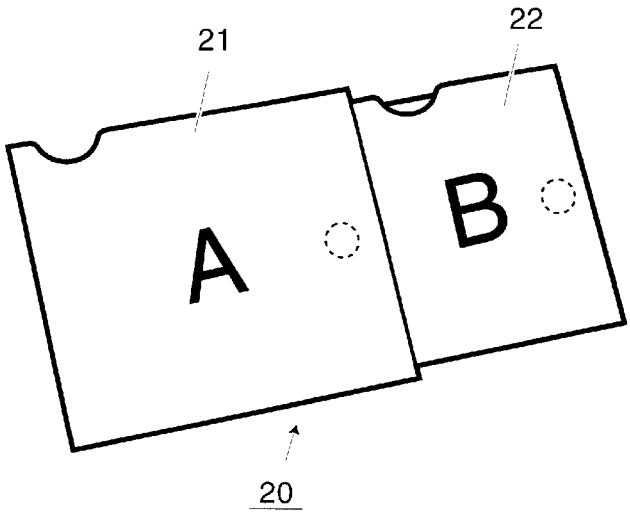
FIG. 3 is a perspective view of the multi-panel display system of FIG. 2 shown with the second element in its fully displayed position directly adjacent the first element.

Element/member 22 is fully retained and stored within element/member 21 and, whenever desired, is arcuately pivoted relative to element/member 21 as shown in FIG. 2. In the preferred construction, element/member 22 is arcuately pivoted through an arcuate distance ranging between about 90° and 270°, with an arcuate distance of about 180° being optimum, in order to enable element/member 22 to be fully visible, directly adjacent element 21, as shown in FIG. 3.

Figure 4:
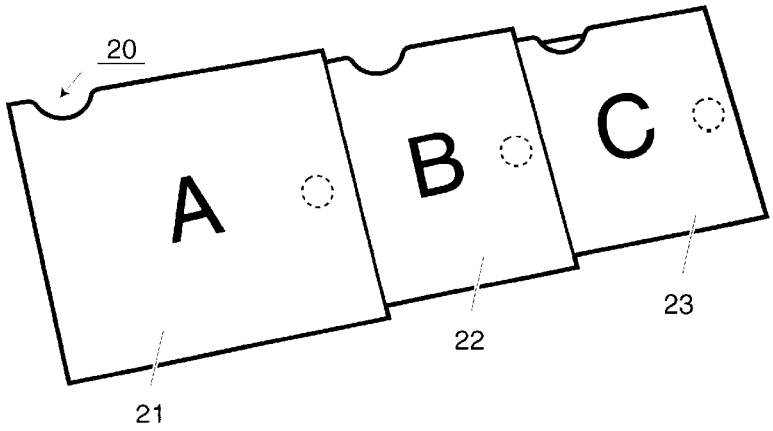
FIGS. 4–6 are perspective views of the multi-panel display system of FIGS. 1–3 with each figure depicting further additional elements in their fully displayed position after being arcuately pivoted from their stored positions.
Figure 5:
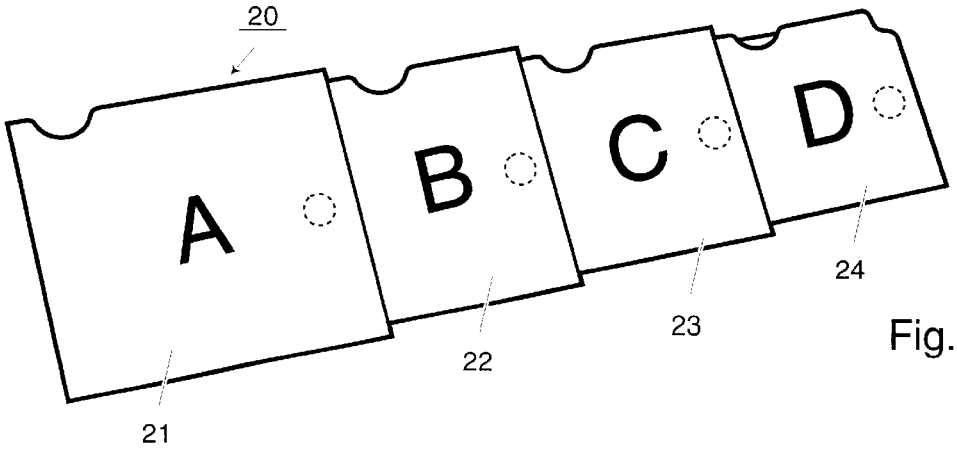
Figure 6:
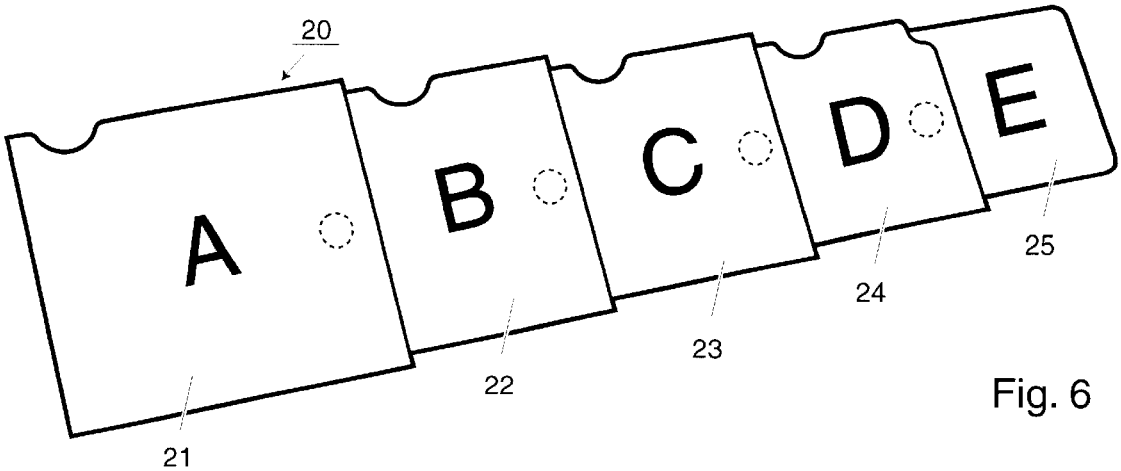

By repeating this identical process, element/member 23 is arcuately pivoted from its stored position within element/member 22 until fully displayed, as shown in FIG. 4. Similarly, element/member 24 is arcuately pivoted from its stored position within element/member 23, whenever desired, into its fully displayed position as shown in FIG. 5. Finally, element/member 25 is similarly stored within element/member 24 and, whenever desired, arcuately pivoted until fully displayed as shown in FIG. 6.

As is clearly evident from this disclosure, multi-panel display product 20 may comprise any desired number of separate and independent elements/members. In addition, if desired, arcuate movement through any desired arcuate path can be established thereby achieving an multi-panel display product 20 which results in curved or circular displays, in addition to the substantially straight, elongated, longitudinally extending product display depicted in FIG. 1–6. Regardless of the resulting configuration attained, each element/member is arcuately pivotable relative to its adjacent element/member with each member being movable from a first, stored position to a second, fully displayed position.

In FIGS. 7 and 8, the preferred construction for achieving multi-panel display product 20 of the present invention is fully depicted. As shown therein, in this preferred construction, element/member 21 comprises a first panel 30 and a second panel 31 which are separated by fold line 32. In addition, flap 33 is also provided, which is separated from panel 30 by fold line 34.

Similarly, element/member 22 comprises a first panel 35 and a second panel 36 which are separated by fold line 37. In addition, panel 35 also comprises flap 38 which is separated from panel 35 by fold line 39.

Elements/members 23 and 24 are constructed in a substantially identical manner, with each element/member 23 and 24 incorporating first panel 40 and second panel 41 which are separated by fold line 42. In addition, each panel 40 also comprises flap 43 which is separated from panel 40 by fold line 44.

Final element 25 has a similar construction, incorporating first panel 45 and second panel 46 interconnected to each other along the fold line 47. Since the final element does not incorporate a member which is pivotally mounted thereto, final element 25 does not incorporate a flap portion.

Prior to assembling element/members 21, 22, 23, 24, and 25 into multi-panel display product 20, each element/member is printed with the desired indicia for providing the desired eye-catching visual display while also detailing the precise advertisement or promotional message being sought. Typically, the indicia comprises a distinctive, eye-catching, visually distinctive, colorful display which produces both interest and excitement as multi-panel display product 20 is opened to its full extent by the consumer.

Finally, apertures 48 are formed in panels 35, 36, 40, 41, 45 and 46 adjacent one edge of each panel. As fully detailed below, apertures 48 of each panel is employed in cooperation with each adjacent element/member for providing the pivot axis about which each element/member is arcuately pivoted. In addition, a notch or cut out zone 49 is formed in panels 30, 31, 35, 36, 40, and 41 to provide a recessed area for enabling the user to easily grasp the element/member retained within an adjacent element/member for initiating the arcuate movement thereof.

Once elements/members 21, 22, 23, 24, and 25 have been printed with the desired distinctive, visually exciting indicia formed on the outer surface of each panel thereof, each element/member is assembled. Typically, the first step in assembling or forming multi-panel display product 20 is to fold flap 33 of element/member 21 along fold line 34, while also folding panel 31 along fold line 32 into juxtaposed, spaced, relationship with panel 30. Then, flap 33 is affixed to the inside surface of panel 31 by appropriate fastening means, such as glue. As shown in FIG. 8, this folding and affixation process forms an interior holding zone 55 between the inside surfaces of panel 31 and panel 30.

As depicted, flap 33 incorporates cutout zones 50 and 51 which form pivot axis defining arms 52 and 53. In the preferred assembly of promotional/advertising product 20, once flap 33 is folded along fold line 34 and affixed to the inside surface of panel 31, pivot axis defining arms 52 and 53 are raised from cutout zones 50 and 51 to extend substantially perpendicularly from flap 33.

In the next step, element/member 22 is assembled by folding flap 38 along fold line 39 while also folding panel 36 along fold line 37 into juxtaposed spaced cooperating relationship with panel 35. Then, element/member 22 is interconnected with element/member 21 in order to provide the desired arcuate pivoting motion. In achieving this result, apertures 48 of panels 35 and 36 are aligned with upstanding pivot defining arms 52 and 53, with arms 52 and 53 being advanced through apertures of 48 of panels 35 and 36. Thereafter, arms 52 and 53 are folded outwardly to securely capture apertures 48 and a surface of each arm 52 and 53 is affixed to the inside surface of panel 30.

In this way, element/member 22 is securely mounted to element/member 21 and is arcuately pivotable relative to element/member 21 about the axis defined by arms 52 and 53. In addition, since element/member 22 is constructed with overall dimensions smaller than element/member 21, element/member 22 is capable of being stowed in its entirety within retaining zone 55 of element/member 21. As a result, element/member 22 is arcuately pivotable from a first, stowed position, wherein element/member 22 is retained entirely within element/member 21, to a second position wherein element/member 22 is arcuately pivoted to a fully displayed position, directly adjacent element/member 21.

Following the identical process detailed above, element/member 23 is assembled and affixed to element member 22 for arcuate movement relative thereto. Similarly, element/members 24 and 25 are assembled and affixed to an adjacent element member for being arcuately movable relative thereto.

As detailed above, in each assembly, the element/member is formed and mounted to its adjacent element/member for being arcuately pivotable from a first stored position to a second display position. In addition, each element/member is fully retained in retaining zone 55 of the adjacent element/member when in its first position. As a result, an exciting and interest-generating multi-panel display product 20 is realized with the consumer experiencing personal involvement in the creation of product 20 as each element/member is pivoted from its sowed position to its displayed position in a repeating, continuous, sequential manner. As a result, consumer involvement and interest is generated and heightened.

In FIG. 9, an alternate embodiment is depicted for providing arcuate pivotability to elements/members 22, 23, 24, and 25 relative to their respective adjacent element/member. In this embodiment, which is depicted for exemplary purposes only showing element/members 22 and 23, foam disk 60 is employed for establishing the desired pivot axis.

In this embodiment, foam disk 60 is constructed in a generally cylindrical configuration incorporating top surface 61 and bottom surface 62. In the preferred construction, a pressure sensitive adhesive is applied to top surface 61 and bottom surface 62, with the pressure sensitive adhesive layers being covered by removable release liners (not shown).

In assembling multi-panel display product 20 of the present invention, foam disk 60 is first affixed to panel 36 by removing the release liner on bottom surface 62 and applying the pressure sensitive adhesive to the inside surface of panel 36. Then, element/member 23 is inserted between panels 35 and 36 of element/member 22, with aperture 48 positioned in coaxial, aligned relationship with foam disk 60. In the preferred construction, aperture 48 comprises a diameter substantially equivalent to the diameter of foam disk 60, thereby enabling foam disk 60 to be easily passed through aperture 48 for enabling aperture 48 to be effectively mounted in peripheral surrounding engagement with the side surfaces of foam disk 60.

Once this assembly is completed, the secure, affixation of elements/member 23 in pivotable, arcuate movement relative to element/member 22 is finalized by merely removing the release liner from surface 61 and securely affixing the pressure sensitive adhesive to the inside surface of panel 35. Once foam disk 60 has been affixed to the inside surfaces of panels 35 and 36 which form element/member 22, and element/member 23 is mounted with its aperture 48 peripherally surrounding and engaging foam disk 60, element/member 23 is easily arcuately pivotable relative to element/member 22. In completing the assembly of multi-panel display product 20 of the present invention, each of the element/members are mounted in arcuate pivoting engagement with each adjacent element/member by employing the identical process detailed above.

As is evident from the foregoing detailed discussion regarding this alternate embodiment, by employing this embodiment, a rapid, easily achieved, assembly construction is attained. In this alternate construction, secure mounted engagement of each element/member relative to each adjacent element/member is realized, with each of the members being arcuately pivotable in the desired manner. Consequently, production costs can be substantially reduced and a more competitive product is attained.

It will thus be seen that the objects set forth above, among those made apparent from the preceding description, are efficiently attained and, since certain changes may be made in the above article without departing from the scope of the invention, it is intended that all matter contained in the above description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desired to secure by Letters Patent is:

1. An interest generating, multi-panel display product for providing users with an exciting, hand operable information display system, said product comprising:

A. a first housing comprising
  a. a first panel, and
  b. a second panel mounted in juxtaposed, spaced, facing, cooperating relationship to the first panel and defining a first holding zone therebetween;

B. a second housing comprising
  a. a third panel,
  b. a fourth panel mounted in juxtaposed, spaced, facing, cooperating relationship to the third panel and defining a second holding zone therebetween; and
  c. said third and fourth panels being dimensioned for retention in said first holding zone formed between said first and second panels; and C. a display panel
  a. comprising two display surfaces forming opposed walls thereof, and
  b. dimensioned for being retained in the second holding zone of the second housing;

D. first pivot means cooperatingly engaging the first housing and the second housing for enabling the second housing to be arcuately pivotable relative to the first housing for movement between a first stored position in said first housing and a second displayed position; and E. second pivot means cooperatingly engaging the second housing and the display panel for enabling the display panel to be arcuately pivotable relative to the second housing for movement between a first stored position in said second housing and a second display position;

whereby an exciting and interest generating multi-panel display product is achieved which is easily activated by the user.

2. The multi-panel display product defined in claim 1, wherein said first panel and said second are affixed to each other along at least one edge and said third panel and fourth panel are affixed to each other along at least one edge.

3. The multi-panel display product defined in claim 2, wherein said second housing is dimensioned for being substantially entirely retained in said first holding zone when said housing is in its first stored position.

4. The multi-panel display product defined in claim 3, wherein the third and fourth panels forming the second housing are further defined as comprising outside surfaces incorporating printed indicia thereon which is visible in its substantial entirety when the second housing is in its second position.

5. The multi-panel display product defined in claim 1, wherein the pivot means is further defined as comprising apertures formed in the third and fourth panels and positioned in overlying aligned relationship, and finger members affixed to the first panel and extending therefrom through the apertures of the third and fourth panels, thereby enabling arcuate pivoting movement of the second housing relative to the first housing.

6. The multi-panel display product defined in claim 5, wherein two separate finger members are affixed to the first panel and are folded in opposite directions after passage through the aligned apertures, thereby securing the third and fourth panels in position and assuring ease of pivotability.

7. The multi-panel display product defined in claim 1, wherein the panels forming said first housing and said second housing, and the surfaces forming the display panel are further defined as comprising outside surfaces each of which comprise eye-catching printed indicia thereon for producing a desired visual information display for generating consumer interest.

8. The multi-panel display product defined in claim 7, wherein said second housing is capable of pivoting relative to the first housing through an arc of about 180°.

9. The multi-panel display product defined in claim 1, wherein said second housing is further defined as being arcuately pivotable relative to the first housing through an arc ranging between about 90° and 270°.

10. The multi-panel display product defined in claim 1, wherein said first and second panels each incorporate a notched area formed therein for providing ease of access to the second housing retained therebetween.

11. The multi-panel display product defined in claim 1, wherein the pivot means comprises apertures formed in the third and fourth panel and a post member affixed to the first and second panel and extending through the apertures, thereby enabling arcuate pivoting movement of the second housing relative to the first housing.

12. The multi-panel display product defined in claim 1, and further comprising:

F. at least one additional housing mounted between the second housing and the display panel and comprising a pair of juxtaposed, spaced, facing and cooperating panel members and defining at least one additional holding zone therebetween, G. said additional housing being dimensioned for retention in one adjacent housing, and H. at least one additional pivot means cooperatingly engaging the adjacent housing for enabling the additional housing to be arcuately pivotable relative thereto.

13. An interest generating multi-panel display product for providing users with an exciting, hand operable information display system, said product comprising:

A. a first housing comprising
  a. a first panel, and
  b. a second panel mounted in juxtaposed, spaced, facing, cooperating relationship to the first panel and defining a first holding zone therebetween;

B. a second housing comprising
  a. a third panel,
  b. a fourth panel mounted in juxtaposed, spaced, facing, cooperating relationship to the third panel and defining a second holding zone therebetween; and
  c. said third and fourth panels being dimensioned for retention in said first holding zone formed between said first and second panels; and C. pivot means cooperatively engaging the first housing and the second housing for enable the second housing to be arcuately pivotable relative to the first housing for movement between a first stored position and a second displayed position;

D. a plurality of additional housings, each comprising a pair of juxtaposed, spaced, facing, and cooperating panel members, affixed to each other along at least one edge and defining a holding zone therebetween;

E. each of said additional housings being dimensioned for retention in one adjacent housing, and F. pivot means cooperatingly engaging adjacent housings for enabling one housing to be arcuately pivotable relative to the other housing;

whereby an exciting and interest generating multi-panel display product is achieved which is easily activated by the user.

14. The multi-panel display product defined in claim 13, and further comprising:

G. a final display panel comprising eye-catching visual information printed thereon and being pivotally mounted to a last housing of said plurality of additional housing for movement between a first stored position and a second displayed position.

15. An interest generating, multi-panel display product for providing users with an exciting, hand operable information display system, said product comprising:

A. a first housing comprising
  a. a first panel, and

B. a second panel mounted in juxtaposed, spaced, facing, cooperating relationship to the first panel and defining a first holding zone therebetween;

B. a second housing comprising
  a. a third panel,
  b. a fourth panel mounted in juxtaposed, spaced, facing, cooperating relationship to the third panel and defining a second holding zone therebetween; and
  c. said third and fourth panels being dimensioned for retention in said first holding zone formed between said first and second panels;

C. a third housing comprising
  a. a fifth panel,
  b. a sixth panel mounted in juxtaposed, spaced, facing, cooperating relationship to the fifth panel and defining a third holding zone therebetween; and D. a fourth housing comprising
  a. a seventh panel,
  b. an eighth panel mounted in juxtaposed, spaced, facing, cooperating relationship to the seventh panel and defining a fourth holding zone therebetween; and
  c. said seventh and eighth panels being dimensioned for retention in said third holding zone;

E. first pivot means cooperatingly engaging the first housing and the second housing for enabling the second housing to be arcuately pivotable relative to the first housing for movement between a first stored position and a second displayed position;

F. second pivot means cooperatingly engaging the second housing and the third housing for enabling the third housing to be arcuately pivotable relative to the second housing from a first storage position to a second display position; and G. third pivot means cooperatingly engaging the third housing and the fourth housing for enabling the fourth housing to be arcuately pivotable relative to the third housing from a first storage position to a second display position;

whereby an exciting and interest generating multi-panel display product is achieved which is easily activated by the user.

16. The multi-panel display product defined in claim 15, wherein said second housing is dimensioned for being substantially entirely retained in said first holding zone when said second housing is in its first stored position, and the third housing is dimensioned for being substantially entirely retained in the second housing when said third housing is in its stored position and the fourth housing is dimensioned for being substantially entirely retained in the third housing when said fourth housing is in its stored position.

17. The multi-panel display product defined in claim 16, wherein the panels forming each housing are further defined as comprising outside surfaces, each of which comprise eye-catching printed indicia thereon for producing a desired visual information display for generating consumer interest.

18. The multi-panel display product defined in claim 15, wherein said second housing is further defined as being arcuately pivotable relative to the first housing through an arc ranging between about 90° and 270°, said third housing is arcuately pivotable relative to the second housing through an arc ranging between about 90° and 270°, and said fourth housing is arcuately pivotable relative to the third housing through an arc ranging between about 90° and 270°.

19. The multi-panel display product defined in claim 15, wherein the panels forming each housing incorporate a notched area formed therein for providing ease of access to the housing retained therebetween.

20. The multi-panel display product defined in claim 15, and further comprising:

H. a final display panel comprising the desired eye-catching visual information printed thereon and pivotally mounted to the fourth housing for movement between a first stored position and a second display position.

* * * * *